US009013289B2

(12) United States Patent
Nishikawa et al.

(10) Patent No.: US 9,013,289 B2
(45) Date of Patent: Apr. 21, 2015

(54) DISPLAY DEVICE FOR WORK MACHINE

(75) Inventors: Shinji Nishikawa, Kasumigaura (JP); Kouji Ishikawa, Kasumigaura (JP); Takatoshi Ooki, Kasumigaura (JP); Keiichiro Nakamura, Mito (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 41 days.

(21) Appl. No.: 14/004,537

(22) PCT Filed: Apr. 6, 2012

(86) PCT No.: PCT/JP2012/059587

§ 371 (c)(1),
(2), (4) Date: Sep. 11, 2013

(87) PCT Pub. No.: WO2012/141110

PCT Pub. Date: Oct. 18, 2012

(65) Prior Publication Data

US 2013/0342340 A1 Dec. 26, 2013

(30) Foreign Application Priority Data

Apr. 15, 2011 (JP) ..... 2011-091575

(51) Int. Cl.

| | |
|---|---|
| ***B60Q 1/00*** | (2006.01) |
| ***E02F 9/26*** | (2006.01) |
| ***E02F 9/20*** | (2006.01) |
| ***E02F 9/22*** | (2006.01) |

(52) U.S. Cl.

CPC ..... *E02F 9/26* (2013.01); *E02F 9/2066* (2013.01); *E02F 9/2296* (2013.01)

(58) Field of Classification Search

USPC ..... 340/439, 425.5, 438, 440, 441, 691.1, 340/691.6

See application file for complete search history.

(56) References Cited

U.S. PATENT DOCUMENTS

| | | | | |
|---|---|---|---|---|
| 7,269,490 | B2 * | 9/2007 | Matsuda | 701/50 |
| 7,395,870 | B2 * | 7/2008 | Matsuda et al. | 172/2 |
| 2005/0149244 | A1 | 7/2005 | Matsuda | |
| 2005/0150142 | A1 | 7/2005 | Matsuda et al. | |
| 2007/0156319 | A1 | 7/2007 | Matsuda et al. | |

FOREIGN PATENT DOCUMENTS

| | | |
|---|---|---|
| JP | 2005-068830 A | 3/2005 |
| JP | 2005-098073 A | 4/2005 |
| JP | 2008-062791 A | 3/2008 |

OTHER PUBLICATIONS

International Preliminary Report on Patentability received in International Application No. PCT/JP2012/059587 dated Oct. 24, 2013.

* cited by examiner

*Primary Examiner* — Toan N Pham

(74) *Attorney, Agent, or Firm* — Mattingly & Malur, PC

(57) ABSTRACT

Disclosed is a display device 5 for a work machine having an engine 9, a hydraulic pump 10 driven by the engine, a boom cylinder 3*d*, an arm cylinder 3*e*, a bucket cylinder 3*f*, and other actuators driven by a hydraulic fluid supplied from the hydraulic pump 10, and an operating device 6 for operating the actuators 3*d*, 3*e*, 3*f*. The display device 5 includes an idle state display section 50*a* for displaying an engine revolution speed N as no-manipulation period operating state information which is related to an engine load that is imposed while the operating device 6 is not manipulated. This makes it possible to inform an operator of the status of the engine load in an idle state for the purpose of prompting the operator to transition into a fuel-efficient state.

4 Claims, 7 Drawing Sheets

DISPLAY DEVICE FOR WORK MACHINE

TECHNICAL FIELD

The present invention relates to a display device for a work machine such as a hydraulic excavator.

BACKGROUND ART

A display device disposed in a cab of a hydraulic excavator or other work machine displays various indicators and machine body information to let an operator confirm the status of the work machine. Information displayed by such a display device includes fuel consumption information about a work vehicle. A display device disclosed, for instance, in Patent Document 1 includes a fuel consumption calculation section and a fuel consumption display section for the purpose of prompting the operator to conduct an energy-saving operation (refer, for instance, to Patent Document 1). The fuel consumption calculation section calculates the fuel consumption of the work vehicle. The fuel consumption display section indicates whether the fuel consumption calculated by the fuel consumption calculation section is below a target fuel consumption.

PRIOR ART LITERATURE

Patent Document

Patent Document 1: JP, A2008-62791

SUMMARY OF THE INVENTION

Problem to be Solved by the Invention

The above-described prior art indicates the fuel consumption by varying the length of a displayed bar in real time. When the displayed bar indicative of the fuel consumption exceeds a point corresponding to the target fuel consumption, a portion not lower than the target fuel consumption is displayed in a color different from the color used for a portion below the target fuel consumption. However, the above-described prior art does not particularly consider the fuel consumption in an idle state. This problem has to be solved.

The present invention has been made in view of the above circumstances. An object of the present invention is to provide a work machine display device that is capable of prompting an operator to transition into a fuel-efficient state by informing the operator of the status of an engine load in an idle state.

Means for Solving the Problem (1) In accomplishing the above object, according to an aspect of the present invention, there is provided a display device disposed in a cab of a work machine having an engine, a hydraulic pump driven by the engine, a plurality of actuators driven by a hydraulic fluid supplied from the hydraulic pump, and an operating device for operating the actuators. The display device includes an idle state display section for displaying no-manipulation period operating state information, which is related to an engine load that is imposed while the operating device is not manipulated.

As described above, the employed configuration includes the idle state display section for displaying the no-manipulation period operating state information which is related to the engine load that is imposed while the operating device is not manipulated, and permits the idle state display section to indicate whether the revolution speed of the engine is minimized while the operating device is not manipulated. This makes it possible to inform the operator of the status of the engine load in an idle state, thereby prompting the operator to transition into a fuel-efficient state.

(2) According to another aspect of the present invention, there is provided the display device as described in (1) above, further including an operating state display section that is disposed contiguously to the idle state display section to display manipulation period operating state information which is related to the engine load that is imposed while the operating device is manipulated.

(3) According to yet another aspect of the present invention, there is provided the display device as described in (1) or (2) above, wherein the idle state display section includes a low-idle display section and a high-idle display section, which switch between an illuminated state and an extinguished state in accordance with the no-manipulation period operating state information. The high-idle display section goes into the illuminated state only when the no-manipulation period operating state information is higher than a predetermined reference value.

(4) According to still another aspect of the present invention, there is provided the display device as described in (3) above, wherein the no-manipulation period operating state information is the revolution speed of the engine.

(5) According to an additional aspect of the present invention, there is provided the display device as described in any one of (2) to (4) above, wherein the manipulation period operating state information is the fuel consumption of the engine.

(6) According to a yet additional aspect of the present invention, there is provided the display device as described in any one of (2) to (4) above, wherein the manipulation period operating state information is the output of the hydraulic pump.

Advantages of the Invention

The present invention makes it possible to prompt the operator to transition into a fuel-efficient state by informing the operator of the status of the engine load in the idle state.

MODE FOR CARRYING OUT THE INVENTION

Embodiments of the present invention will now be described with reference to the accompanying drawings.

First Embodiment

A first embodiment of the present invention will now be described with reference to FIGS. 1 to 6 and 9.

Figure 9:
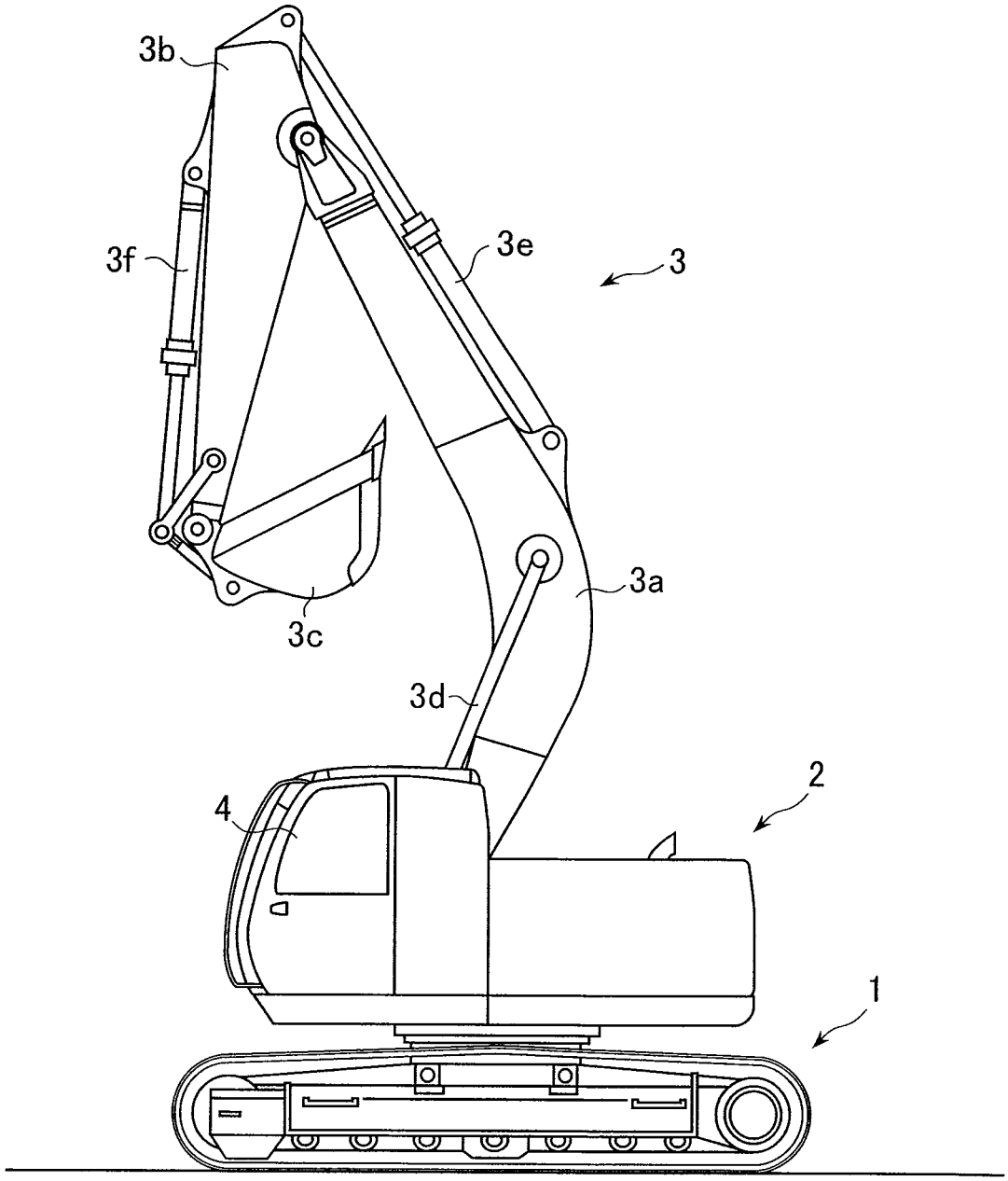
FIG. 9 is an external view illustrating the hydraulic excavator that is shown as an example of a work machine according to an embodiment of the present invention.

FIG. 9 is an external view illustrating a hydraulic excavator that is shown as an example of a work machine according to an embodiment of the present invention.

Referring to FIG. 9, the hydraulic excavator (work machine) substantially includes a crawler-type lower travel structure 1, an upper swing structure 2 swingably mounted on the lower travel structure 1, and a front work device 3 having, for example, excavating means.

The lower travel structure 1 includes a pair of travel hydraulic motors (not shown). The travel hydraulic motors, their speed reduction mechanisms, and the like rotationally drive crawlers on an individual basis, thereby causing the hydraulic excavator to travel forward or backward.

The upper swing structure 2 includes, for example, a cab 4, an engine or other prime mover, a hydraulic pump, and a swing motor (not shown). An operating device 6 for operating the hydraulic excavator in various manners and a cab seat on which an operator is seated are disposed in the cab 4. The swing motor turns the upper swing structure 2 rightward or leftward with respect to the lower travel structure 1. A display device 5 is disposed in the cab 4. The display device 5 displays various indicators and machine body information to let the operator confirm the status of the hydraulic excavator (work machine).

The front work device 3 includes a boom 3*a*, an arm 3*b*, and a bucket 3*c*. A boom cylinder 3*d* moves the boom 3*a* up and down. An arm cylinder 3*e* moves the arm 3*b* into a dumping position (unfolding position) or into a crowding position (raking position). A bucket cylinder 3*f* moves the bucket 3*c* into a dumping position or into a crowding position.

Figure 1:
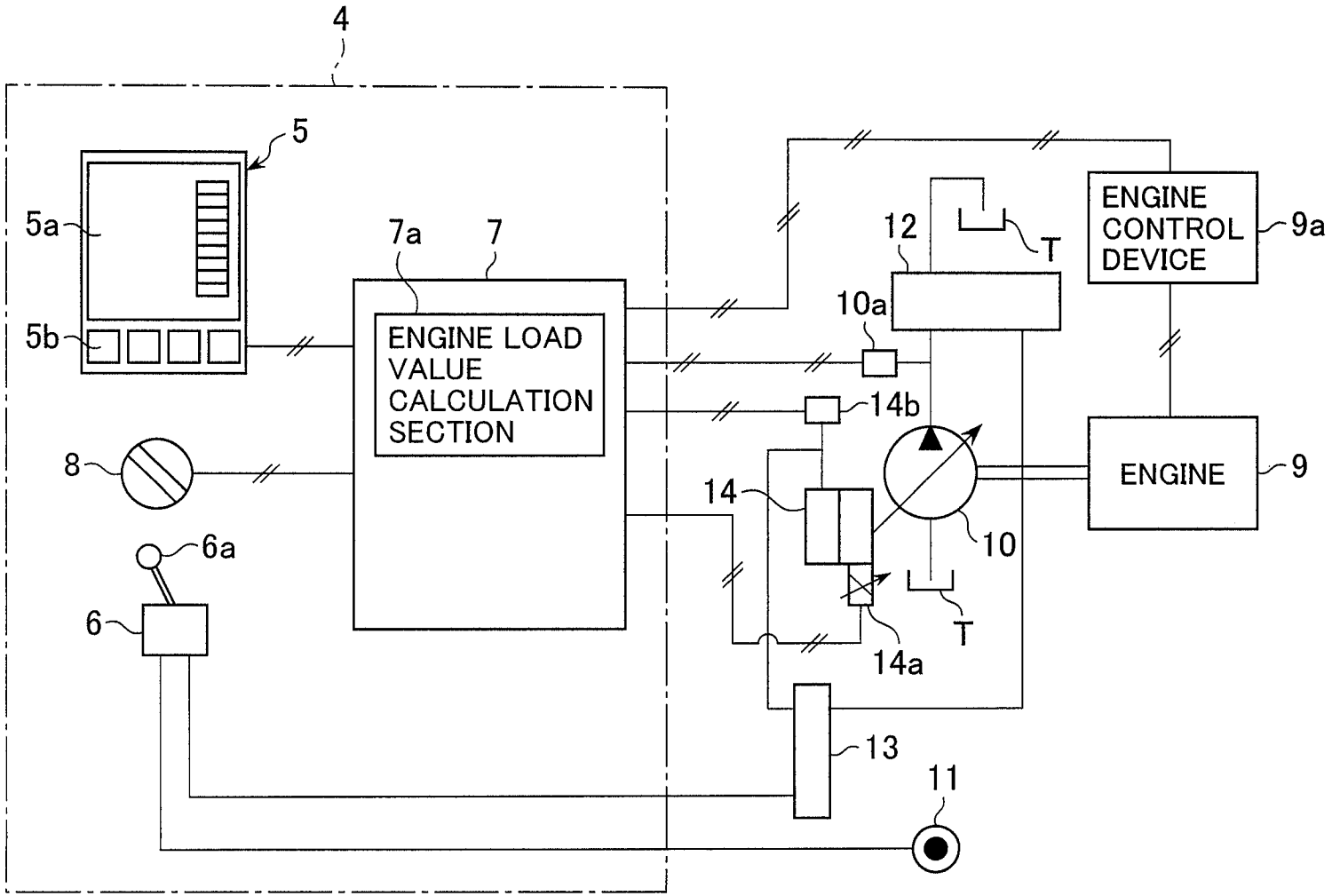
FIG. 1 is a schematic diagram illustrating a hydraulic excavator according to a first embodiment of the present invention as well as a display device and a peripheral configuration thereof.

FIG. 1 is a schematic diagram illustrating the hydraulic excavator according to the present embodiment as well as the display device 5 and a peripheral configuration thereof.

As shown in FIG. 1, the cab 4 of the hydraulic excavator includes a machine body controller 7, the display device 5, an engine control dial (EC dial) 8, and a plurality of operating devices 6 (one operating device is described as a representative in conjunction with the present embodiment). The machine body controller 7 controls the overall operation of a machine body. The display device 5 displays various items of information about the hydraulic excavator in accordance with a signal from the machine body controller 7. The engine control dial (EC dial) 8 issues a command to the machine body controller 7 for the purpose of specifying the revolution speed of the engine 9, which acts as a prime mover. Each operating device 6 issues a command for specifying the operation of each actuator of the hydraulic excavator.

The hydraulic excavator also includes the engine 9, a hydraulic pump 10, a pilot pump 11, control valves 12, signal control valves 13, and a regulator 14. The engine 9 acts as the prime mover. The hydraulic pump 10 is of a variable displacement type and driven by the engine 9. The pilot pump 11 is of a fixed displacement type. The control valves 12 control the hydraulic fluid to be supplied to the boom cylinder 3*d*, the arm cylinder 3*e*, the bucket cylinder 3*f*, and other actuators (see FIG. 9) driven by the hydraulic fluid discharged from the hydraulic pump 10. The signal control valves 13 control manipulation signals supplied from the operating device 6 to the control valves 12. The regulator 14 controls the tilting angle of a swash plate of the hydraulic pump 10.

The operating device 6 has a control lever 6*a*. A manipulation signal is generated when the operator manipulates the control lever 6*a* on the operating device 6. The manipulation signal is supplied to the control valves 12 through the signal control valves to drive a target actuator.

The EC dial 8 is a rotary dial type indicating device. When rotated by the operator, the EC dial 8 issues a command to the machine body controller 7 for the purpose of specifying the revolution speed N of the engine 9. The EC dial 8 is capable of specifying a minimum value and a maximum value within a range of available revolution speeds N of the engine 9 and specifying a continuously variable intermediate value between the minimum and maximum values.

An engine control device 9*a* exchanges signals with the machine body controller 7. The engine control device 9*a* not only controls the drive of the engine 9 in accordance with a control signal (e.g., the revolution speed specified by the EC dial 8) from the machine body controller 7, but also outputs the revolution speed N, fuel injection amount, and other information derived from the engine 9 to the machine body controller 7.

The regulator 14 includes a pump torque control solenoid valve 14*a*, and controls the tilting angle of the hydraulic pump 10 in accordance with a control signal output from the machine body controller 7 to the pump torque control solenoid valve 14*a* and in accordance with a signal generated by the signal control valves 13 on the basis of a manipulation signal supplied from the operating device 6 to the control valves 12.

A hydraulic circuit section includes a pump torque control solenoid valve 14*b* and a pressure sensor 10*a*. The pump torque control solenoid valve 14*b* detects a signal pressure (i.e., the control pressure of the regulator 14) supplied from the signal control valves 13 to the regulator 14. The pressure sensor 10*a* detects the delivery pressure of the hydraulic pump 10. The pump torque control solenoid valve 14*b* and the pressure sensor 10*a* output a respective detection signal to the machine body controller 7. The machine body controller 7 calculates the displacement volume (tilt) of the hydraulic pump 10 in accordance with the control signal output to the pump torque control solenoid valve 14*a*, the detection signal of the pressure sensor 10*a*, and the detection signal of the pump torque control solenoid valve 14*b*.

The machine body controller 7 includes an engine load value calculation section 7*a* for calculating operating state information about the engine, which is related to an engine load. The engine load value calculation section 7*a* calculates the operating state information, such as the revolution speed N [rpm] of the engine 9, a fuel consumption (the amount of fuel consumption) M [L/h], and the pump output W [kW] of the hydraulic pump 10, and outputs the calculated operating state information to the display device 5.

For example, when calculating the pump output W [kW] as the operating state information, the engine load value calculation section 7*a* first calculates a pump flow rate [L/min] from the pump displacement L [$cm^3$] of the hydraulic pump 10 and the engine revolution speed N [$min^{-1}$], and then calculates the pump output W [kW] from the pump flow rate and a pump pressure [MPa].

The display device 5 includes a display section 5*a* and a display operating section 5*b*. The display section 5*a* displays various items of information about the hydraulic excavator. The display operating section 5*b* is used to make various operating control entries. The display and manipulation of various items of information are controlled by a display controller (not shown). The display section 5*a* may be configured as a touch-panel liquid-crystal monitor to double as the display operating section 5*b*.

The display section 5*a* includes an operating state information display section 50 for displaying the operating state information from the machine body controller 7.

Figure 2:
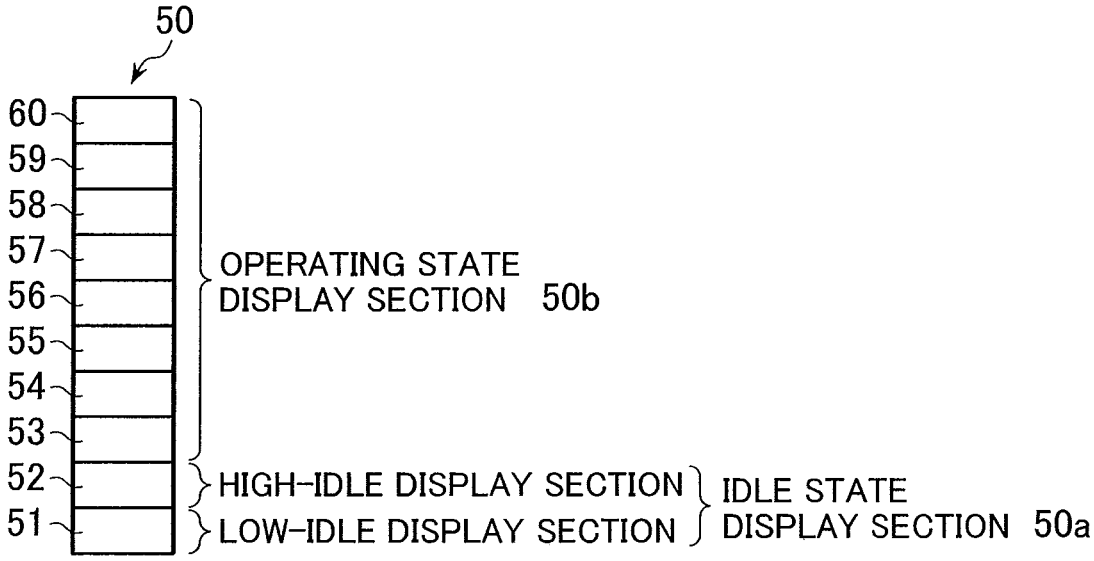
FIG. 2 is a diagram illustrating in detail an operating state information display section displayed on a display section of the display device. This diagram shows a non-displayed state.
Figure 3:
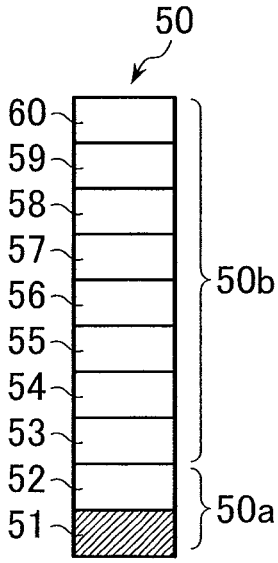
FIG. 3 is a diagram illustrating in detail the operating state information display section displayed on the display section of the display device. This diagram shows a displayed state in a low-idle period.
Figure 4:
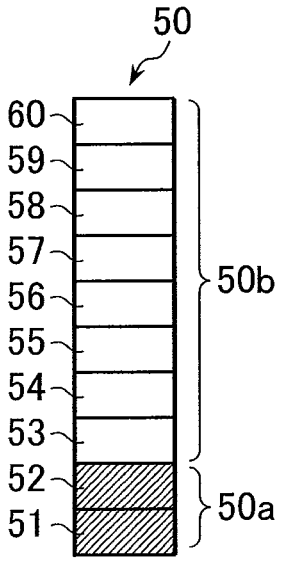
FIG. 4 is a diagram illustrating in detail the operating state information display section displayed on the display section of the display device. This diagram shows a displayed state in a high-idle period.
Figure 5:
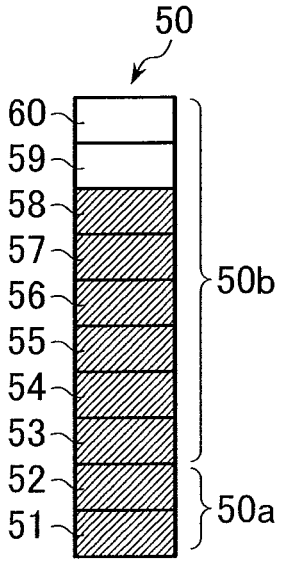
FIG. 5 is a diagram illustrating in detail the operating state information display section displayed on the display section of the display device. This diagram shows a displayed state in a work period.

FIGS. 2 to 5 are diagrams illustrating in detail the operating state information display section 50 displayed on the display section 5*a* of the display device 5. FIG. 2 shows a non-displayed state. FIG. 3 shows a displayed state in a low-idle period. FIG. 4 shows a displayed state in a high-idle period. FIG. 5 shows a displayed state in a work period.

Referring to FIG. 2, the operating state information display section 50 displays manipulation period operating state information and no-manipulation period operating state information, each of which is engine operating state information output from the machine body controller 7. The operating state information display section 50 includes an idle state display section 50*a* and an operating state display section 50*b*. The idle state display section 50*a* displays the no-manipulation period operating state information, which is related to an engine load imposed while the operating device 6 is not manipulated (that is, while the engine 9 is idle). The operating state display section 50*b* is disposed contiguously to the idle state display section 50*a* to display the manipulation period operating state information, which is related to an engine load imposed while the operating device 6 is manipulated.

The idle state display section 50*a* includes a low-idle display section 51 and a high-idle display section 52. These sections 51, 52 are formed of a display cell and switch between an illuminated state and an extinguished state in accordance with the no-manipulation period operating state information. The idle state display section 50*a* uses the engine revolution speed N, which is calculated by the machine body controller 7 and output as the no-manipulation period operating state information, and displays the no-manipulation period operating state information by causing the low-idle display section 51 and the high-idle display section 52 to switch between the illuminated state and the extinguished state in accordance with the engine revolution speed N.

When the revolution speed N of the engine 9 is other than 0 (zero), that is, when the engine 9 of the hydraulic excavator is running, the low-idle display section 51 becomes illuminated (see FIG. 3). The revolution speed N of the engine 9 is calculated by the machine body controller 7 in accordance with a value indicated by the EC dial 8 and with a value detected by the revolution speed detection function of the engine control device 9*a*.

The high-idle display section 52 becomes extinguished when the revolution speed N of the engine 9 is not higher than a predetermined revolution speed N reference value NIo for determining that the revolution speed N of the engine 9 is the minimum value (that is, when the revolution speed N is the minimum value) and when the pump output W is not higher than a predetermined pump output W reference value WIo for determining that the operating device 6 is not being manipulated (that is, when the operating device 6 is not being manipulated). The high-idle display section 52 becomes illuminated when the revolution speed N of the engine 9 is higher than the reference value NIo or when the pump output W is higher than the reference value WIo (that is, when the operating device 6 is being manipulated). The high-idle display section 52 also becomes illuminated when the revolution speed N and the pump output W are both higher than their respective reference values (see FIG. 4).

In other words, when the operating device 6 is not being manipulated and the idle state display section 50*a* indicates that the revolution speed N of the engine 9 is minimized, only the low-idle display section 51 is illuminated and the high-idle display section 50 is extinguished. The low-idle display section 51 and the high-idle display section 50 are both illuminated either when the revolution speed N of the engine 9 is not minimized or when the operating device 6 is being manipulated. This makes it possible to indicate whether the revolution speed N of the engine 9 is minimized while the operating device 6 is not being manipulated. Thus, the operator can intuitively recognize the status of the engine load. Hence, the operator can be prompted to transition into a fuel-efficient state during an idle state.

The operating state display section 50*b* includes a plurality of display cells 53, . . . , 60 (eight display cells in the present example) that switch between an illuminated state and an extinguished state in accordance with the manipulation period operating state information. In the operating state display section 50*b*, the display cells 53, . . . , 60 are disposed contiguously to the high-idle display section 52 of the idle state display section 50*a*. The operating state display section 50*b* uses the pump output W of the hydraulic pump 10, which is calculated by the machine body controller 7 as the manipulation period operating state information, and displays the manipulation period operating state information by switching the individual display cells 53, . . . , 60 between the illuminated state and the extinguished state in accordance with the value of the pump output W.

When the pump output W is higher than the predetermined pump output W reference value WIo for determining that the operating device 6 is not being manipulated (that is, when the operating device 6 is being manipulated), the operating state display section 50*b* switches the individual display cells 53, . . . , 60 between the illuminated state and the extinguished state in accordance with the magnitude of the pump output W. As the pump output W increases, the operating state display section 50*b* sequentially illuminates the display cells beginning with the display cell 53 positioned closest to the idle state display section 50*a* and indicates the magnitude of the pump output W (manipulation period operating state information) by increasing the number of illuminated display cells (see FIG. 5). More specifically, the reference value of the pump output W in a situation where the display cells 53, . . . , 60 are illuminated is predetermined.

When, for instance, a condition under which the display cell 60 farthest from the idle state display section 50*a* is illuminated (a display maximum value Whi) is set and the reference values equally spaced apart from each other for the individual display cells 53, . . . , 60 of the operating state display section 50*b* are set within the range of WIo to Whi, the number of illuminated display cells increases, sequentially from the display cell 53 to the display cell 60, with an increase in the pump output W. This makes it possible to indicate changes in the pump output W. Hence, the operator can intuitively recognize the status of the engine load.

As described above, the display device 5 according to the present embodiment is configured so that the operating state information display section 50 is formed of a plurality of display cells 51, . . . , 60 (ten display cells in the present example), which are vertically and contiguously disposed in the display section 5*a*. Further, the number of illuminated display cells increases with an increase in the no-manipulation period operating state information (the revolution speed N of the engine 9 in the present embodiment), which is related to the engine load, and with an increase in the manipulation period operating state information (the pump output W of the hydraulic pump 10 in the present embodiment), which is also related to the engine load. Therefore, the operator can intuitively recognize the load status of the engine 9. Moreover, the load status of the engine 9 can be regarded as the fuel consumption. Hence, the operator can indirectly recognize the fuel consumption of the engine 9.

A display process performed by the operating state information display section 50 in the display device 5 will now be described in detail with reference to a flowchart of FIG. 6.

Figure 6:
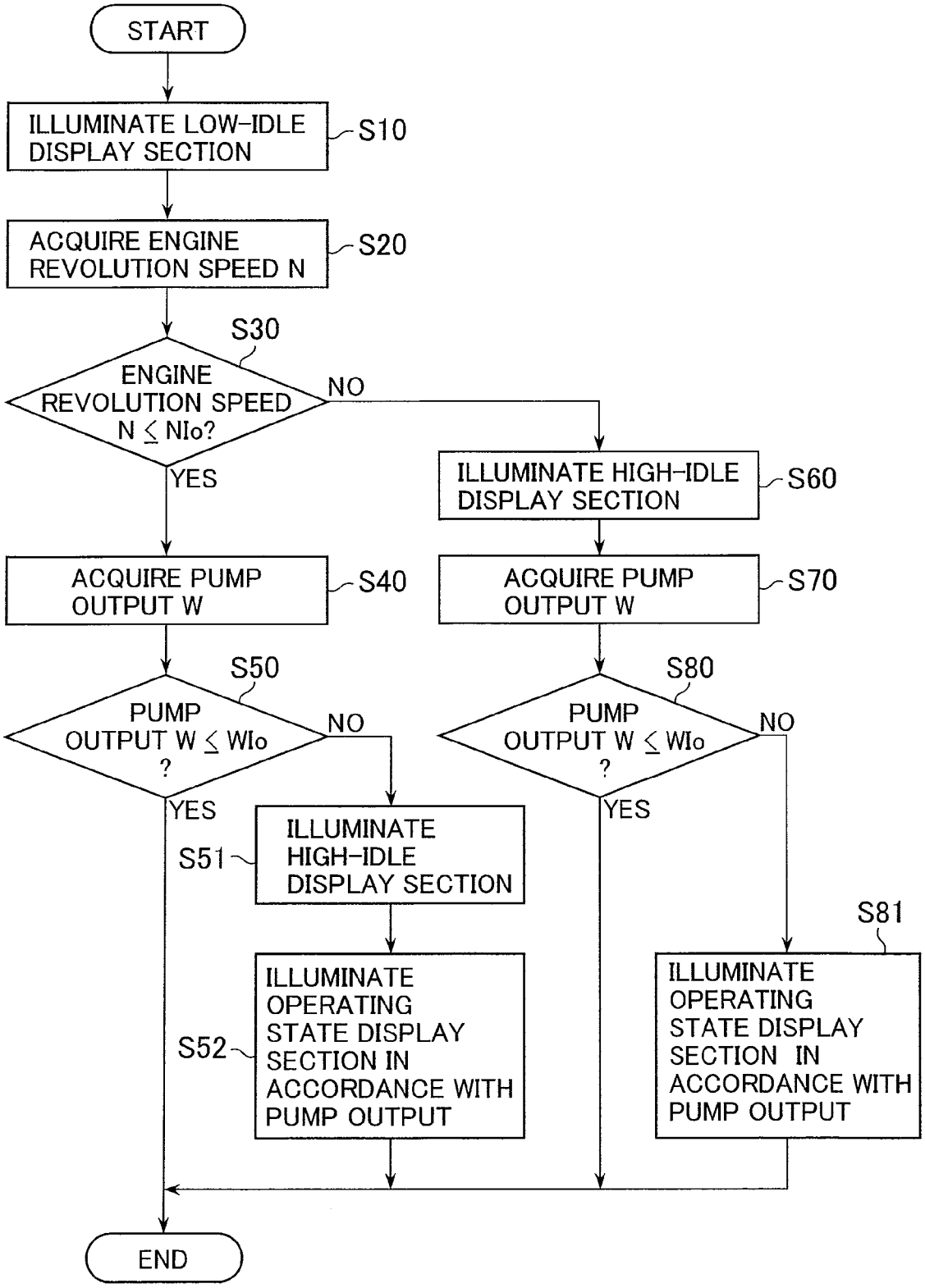
FIG. 6 is a flowchart illustrating a display process according to the first embodiment of the present invention.

FIG. 6 is a flowchart illustrating the display process according to the present embodiment.

When the hydraulic excavator is in an operating state, the display device 5 first illuminates the low-idle display section 51 of the operating state information display section 50 (step S10). Next, the display device 5 acquires the revolution speed N of the engine 9 from the machine body controller 7 (step S20). The display device 5 then determines whether the acquired revolution speed N is not higher than the predetermined reference value NIo (step S30). If the determination result obtained in step S30 is YES, the display device 5 acquires a calculation result of the pump output W of the hydraulic pump 10 from the machine body controller 7 (step S40) and determines whether the acquired pump output W is not higher than the predetermined reference value WIo (step S50). If the determination result obtained in step S50 is YES, the display device 5 terminates the process. If, on the other hand, the determination result obtained in step S50 is NO, the display device 5 illuminates the high-idle display section 52 (step S51), then illuminates the corresponding display cells 53, . . . , 60 of the operating state display section 50*b* in accordance with the magnitude of the pump output W (step S52), and terminates the process. If the determination result obtained in step S30 is NO, the display device 5 illuminates the high-idle display section 52 (step S60). Next, the display device 5 acquires the calculation result of the pump output W of the hydraulic pump 10 from the machine body controller 7 (step S70) and determines whether the acquired pump output W is not higher than the predetermined reference value WIo (step S80). If the determination result obtained in step S80 is YES, the display device 5 terminates the process. If, on the other hand, the determination result obtained in step S80 is NO, the display device 5 illuminates the corresponding display cells 53, . . . , 60 of the operating state display section 50*b* in accordance with the magnitude of the pump output W (step S81), and terminates the process.

Operations performed by the present embodiment, which is configured as described above, will now be described.

When the operator seated on the cab seat in the cab 4 manipulates the operating device 6 to conduct work with the front work device 3, the operator uses the EC controller 8 to set a desired revolution speed N of the engine 9 depending on whether the work is heavy or light.

When the minimum value is selected on the EC controller 8, the display cells 51, 52 of the operating state information display section 50 become illuminated while the operating device 6 is manipulated. In addition, the display cells 53, . . . , 60 become illuminated in accordance with the pump output W [kW] to convey the manipulation period operating state information, which is related to the engine load, to the operator. While the operating device 6 is not manipulated, only the display cell (low-idle display section) 51 becomes illuminated to inform the operator that a low-idle state prevails.

When a value other than the minimum value is selected on the EC controller 8, the display cells 51, 52 of the operating state information display section 50 become illuminated while the operating device 6 is manipulated. In addition, the display cells 53, . . . , 60 become illuminated in accordance with the pump output W [kW] to convey the manipulation period operating state information, which is related to the engine load, to the operator. While the operating device 6 is not manipulated, both the display cell (low-idle display section) 51 and the display cell 52 (high-idle display section) become illuminated to inform the operator that a high-idle state prevails. This makes it possible to inform the operator of the status of the engine load in an idle state for the purpose of prompting the operator to transition into a fuel-efficient state, that is, select the minimum value on the EC controller 8 to transition into the low-idle state.

An advantage provided by the present embodiment, which is configured as described above, will now be described.

The prior art indicates the fuel consumption by varying the length of a displayed bar in real time. When the displayed bar indicative of the fuel consumption exceeds a point corresponding to a target fuel consumption, a portion not lower than the target fuel consumption is displayed in a color different from the color used for a portion below the target fuel consumption. However, the above-described prior art does not particularly consider the fuel consumption in the idle state. This problem has to be solved.

Meanwhile, the present embodiment is configured to include the idle state display section 5*a* for displaying the no-manipulation period operating state information, which is related to the load imposed on the engine 9 while the operating device 6 is not manipulated. This makes it possible to inform the operator of the status of the engine load in an idle state for the purpose of prompting the operator to transition into a fuel-efficient state.

The present embodiment has been described on the assumption that the pump output W [kW] is used as the manipulation period operating state information to be displayed on the operating state display section 50*b* of the operating state information display section 50. However, the present invention is not limited to the use of such manipulation period operating state information. The fuel consumption (the amount of fuel consumption) M [L/h] may alternatively be used as the manipulation period operating state information.

Further, the present embodiment has been described on the assumption that the operating state information display section 50 is formed of a plurality of display cells 51, . . . , 60 (ten display cells in the present example), which are arranged vertically and contiguously. However, the present invention is not limited to the use of such a formation. For example, the operating state information display section 50 may alternatively be formed of the display cells 51, . . . , 60 that are arranged from left to right. Furthermore, the display cells 51, . . . , 60 forming the operating state information display section 50 need not always be arranged in a straight line. For example, the display cells 51, . . . , 60 may alternatively be arranged in a curved or bent line. Moreover, the display cells 51, . . . , 60 forming the operating state information display section 50 need not always be in the same shape. For example, the display cell 51 may alternatively differ from the display cell 52 in the length of the direction of arrangement. Besides, the high-idle display section 52 of the idle state display section 50*a* need not always be formed of one display cell. For example, the high-idle display section 52 may alternatively be formed of two or more display cells and configured so that the number of illuminated display cells increases with an increase in the revolution speed N of the engine 9.

Second Embodiment

A second embodiment of the present invention will now be described with reference to FIGS. 7 and 8. Elements identical with those described in conjunction with the first embodiment are designated by the same reference numerals as their counterpart elements and will not be redundantly described.

Figure 7:
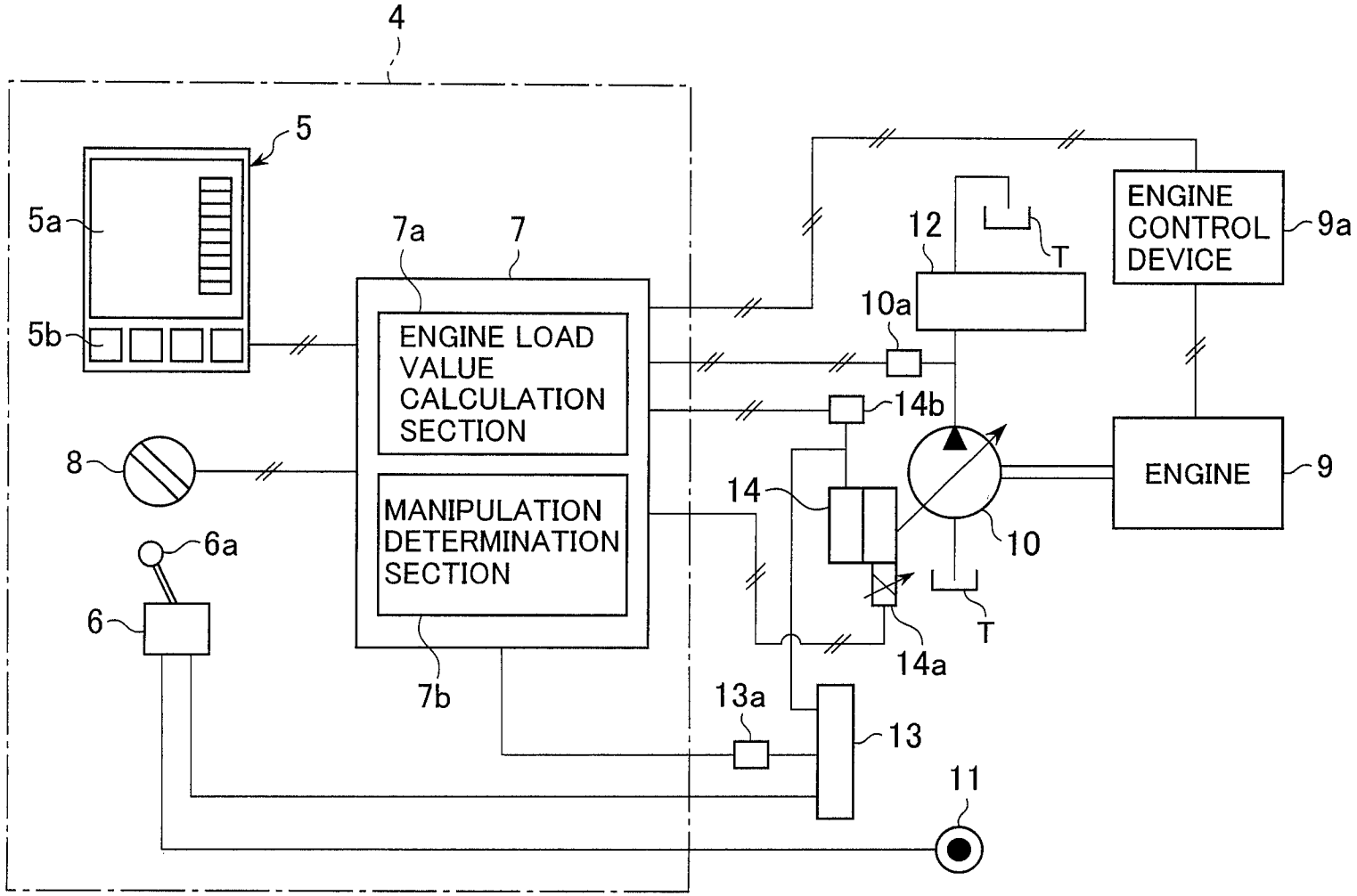
FIG. 7 is a schematic diagram illustrating the hydraulic excavator according to a second embodiment of the present invention as well as the display device and a peripheral configuration thereof.

FIG. 7 is a schematic diagram illustrating the hydraulic excavator according to the second embodiment as well as the display device 5 and a peripheral configuration thereof.

As shown in FIG. 7, the cab 4 of the hydraulic excavator includes a machine body controller 7A, the display device 5, the engine control dial (EC dial) 8, and a plurality of operating devices 6 (one operating device is described as a representative in conjunction with the present embodiment). The machine body controller 7A controls the overall operation of the machine body. The display device 5 displays various items of information about the hydraulic excavator in accordance with a signal from the machine body controller 7A. The engine control dial (EC dial) 8 issues a command to the machine body controller 7A for the purpose of specifying the revolution speed of the engine 9, which acts as a prime mover. Each operating device 6 issues a command for specifying the operation of each actuator of the hydraulic excavator.

The hydraulic excavator also includes the engine 9, the hydraulic pump 10, the pilot pump 11, the control valves 12, the signal control valves 13, and the regulator 14. The engine 9 acts as the prime mover. The hydraulic pump 10 is of a variable displacement type and driven by the engine 9. The pilot pump 11 is of a fixed displacement type. The control valves 12 control the hydraulic fluid to be supplied to the boom cylinder 3*d*, the arm cylinder 3*e*, the bucket cylinder 3*f*, and other actuators (see FIG. 9) driven by the hydraulic fluid discharged from the hydraulic pump 10. The signal control valves 13 control manipulation signals supplied from the operating device 6 to the control valves 12. The regulator 14 controls the tilting angle of the swash plate of the hydraulic pump 10.

The operating device 6 has the control lever 6*a*. A manipulation signal is generated when the operator manipulates the control lever 6*a* on the operating device 6. The manipulation signal is supplied to the control valves 12 through the signal control valves to drive a target actuator.

The EC dial 8 is a rotary dial type indicating device. When rotated by the operator, the EC dial 8 issues a command to the machine body controller 7A for the purpose of specifying the revolution speed N of the engine 9. The EC dial 8 is capable of specifying the minimum value and the maximum value within the range of available revolution speeds N of the engine 9 and specifying a continuously variable intermediate value between the minimum and maximum values.

The engine control device 9*a* exchanges signals with the machine body controller 7A. The engine control device 9*a* not only controls the drive of the engine 9 in accordance with a control signal (e.g., the revolution speed specified by the EC dial 8) from the machine body controller 7A, but also outputs the revolution speed N, fuel injection amount, and other information derived from the engine 9 to the machine body controller 7A.

The regulator 14 includes the pump torque control solenoid valve 14*a*, and controls the tilting angle of the hydraulic pump 10 in accordance with a control signal output from the machine body controller 7A to the pump torque control solenoid valve 14*a* and in accordance with a signal generated by the signal control valves 13 on the basis of a manipulation signal supplied from the operating device 6 to the control valves 12.

The hydraulic circuit section includes the pump torque control solenoid valve 14*b*, the pressure sensor 10*a*, and a manipulation pressure sensor 13*a*. The pump torque control solenoid valve 14*b* detects a signal pressure (i.e., the control pressure of the regulator 14) supplied from the signal control valves 13 to the regulator 14. The pressure sensor 10*a* detects the delivery pressure of the hydraulic pump 10. The manipulation pressure sensor 13*a* detects a manipulation signal pressure supplied from the operating device 6 to the signal control valves 13. The pump torque control solenoid valve 14*b*, the pressure sensor 10*a*, and the manipulation pressure sensor 13*a* output a respective detection signal to the machine body controller 7A. The machine body controller 7A calculates the displacement volume (tilt) of the hydraulic pump 10 in accordance with the control signal output to the pump torque control solenoid valve 14*a*, the detection signal of the pressure sensor 10*a*, and the detection signal of the pump torque control solenoid valve 14*b*.

The machine body controller 7A includes the engine load value calculation section 7*a* for calculating the operating state information about the engine, which is related to the engine load, and a manipulation determination section 7*b*, which determines in accordance with the manipulation signal pressure of the operating device 6 that a manipulation state prevails. The engine load value calculation section 7*a* calculates the operating state information, such as the revolution speed N [rpm] of the engine 9, the fuel consumption (the amount of fuel consumption) M [L/h], and the pump output W [kW] of the hydraulic pump 10, and outputs the calculated operating state information to the display device 5. For example, when calculating the pump output W [kW] as the operating state information, the engine load value calculation section 7*a* first calculates the pump flow rate [L/min] from the pump displacement L [$cm^3$] of the hydraulic pump 10 and the engine revolution speed N [$min^{-1}$], and then calculates the pump output W [kW] from the pump flow rate and the pump pressure [MPa].

The display device 5 includes the display section 5*a* and the display operating section 5*b*. The display section 5*a* displays various items of information about the hydraulic excavator. The display operating section 5*b* is used to make various operating control entries. The display and manipulation of various items of information are controlled by the display controller (not shown). The display section 5*a* may be configured as a touch-panel liquid-crystal monitor to double as the display operating section 5*b*.

The display section 5*a* includes an operating state information display section 50 for displaying the operating state information from the machine body controller 7A.

Figure 8:
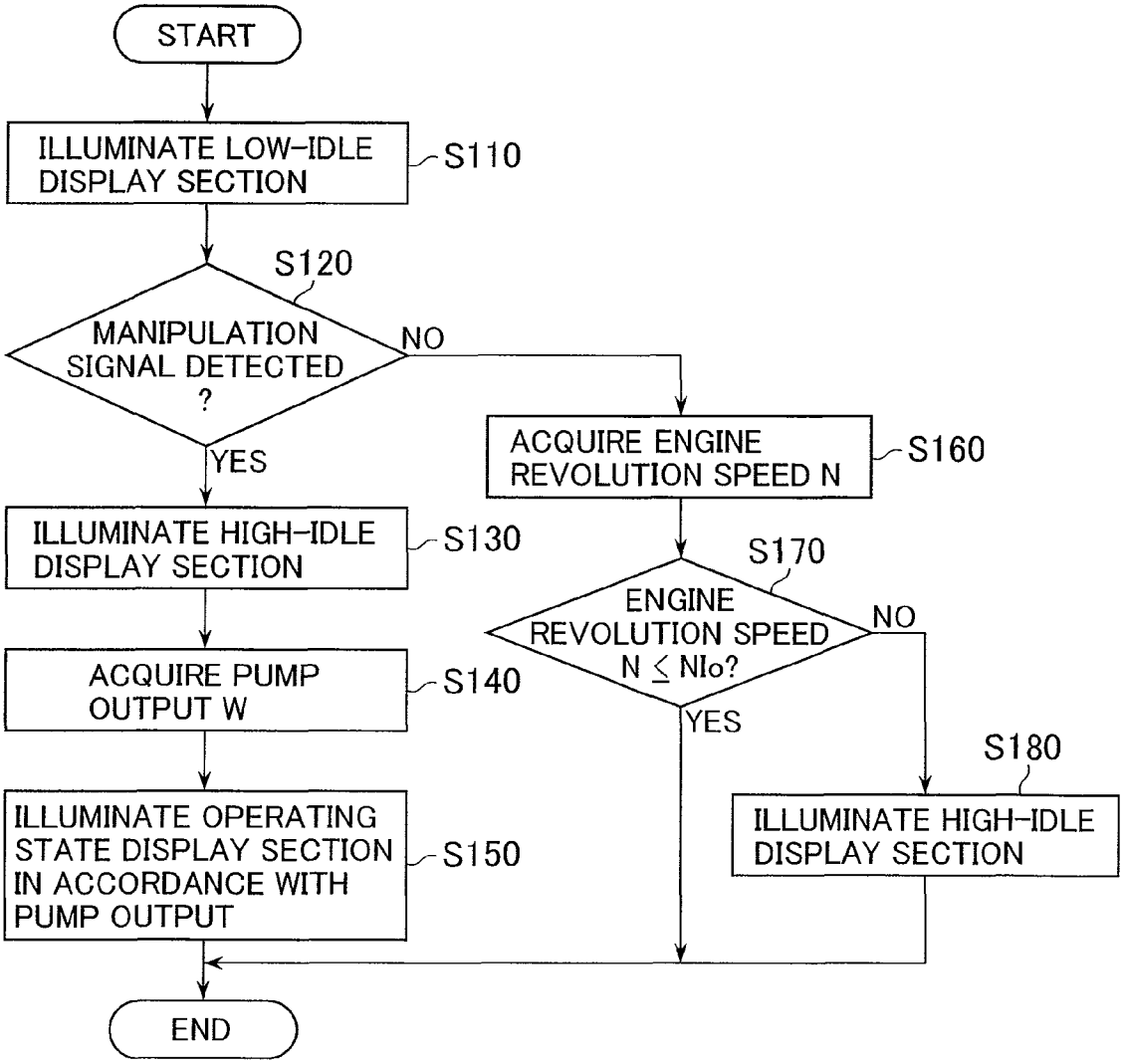
FIG. 8 is a flowchart illustrating the display process according to the second embodiment of the present invention.

FIG. 8 is a flowchart illustrating the display process according to the present embodiment.

When the hydraulic excavator is in an operating state, the display device 5 first illuminates the low-idle display section 51 of the operating state information display section 50 (step S110). Next, the display device 5 determines whether a manipulation signal is detected by the manipulation pressure sensor 13*a*. If the determination result is YES, the display device 5 illuminates the high-idle display section 52 (step S130). Next, the display device 5 acquires the calculation result of the pump output W of the hydraulic pump 10 from the machine body controller 7A (step S140), then illuminates the corresponding display cells 53, . . . , 60 of the operating state display section 50*b* in accordance with the magnitude of the pump output W (step S150), and terminates the process. If the determination result obtained in step S120 is NO, the display device 5 acquires the engine revolution speed N from the machine body controller 7A (step S160), and determines whether the acquired revolution speed N is not higher than a predetermined reference value Io (step S170). If the determination result obtained in step S170 is YES, the display device 5 terminates the process. If, on the other hand, the determination result obtained in step S170 is NO, the display device 5 illuminates the high-idle display section 52 (step S180) and then terminates the process.

In the other respects, the configuration of the present embodiment is the same as that of the first embodiment.

Operations performed by the present embodiment, which is configured as described above, will now be described.

When the operator seated on the cab seat in the cab 4 manipulates the operating device 6 to conduct work with the front work device 3, the operator uses the EC controller 8 to set a desired revolution speed N of the engine 9 depending on whether the work is heavy or light.

When the minimum value is selected on the EC controller 8, the display cells 51, 52 of the operating state information display section 50 become illuminated while the operating device 6 is manipulated. In addition, the display cells 53, . . . , 60 become illuminated in accordance with the pump output W [kW] to convey the manipulation period operating state information, which is related to the engine load, to the operator. While the operating device 6 is not manipulated, only the display cell (low-idle display section) 51 becomes illuminated to inform the operator that the low-idle state prevails.

When a value other than the minimum value is selected on the EC controller 8, the display cells 51, 52 of the operating state information display section 50 become illuminated while the operating device 6 is manipulated. In addition, the display cells 53, . . . , 60 become illuminated in accordance with the pump output W [kW] to convey the manipulation period operating state information, which is related to the engine load, to the operator. While the operating device 6 is not manipulated, both the display cell (low-idle display section) 51 and the display cell 52 (high-idle display section) become illuminated to inform the operator that the high-idle state prevails. This makes it possible to inform the operator of the status of the engine load in an idle state for the purpose of prompting the operator to transition into a fuel-efficient state, that is, select the minimum value on the EC controller 8 to transition into the low-idle state.

The present embodiment, which is configured as described above, provides the same advantage as the first embodiment.

DESCRIPTION OF REFERENCE NUMERALS

1 . . . Lower travel structure
2 . . . Upper swing structure
3 . . . Front work device
4 . . . Cab
5 . . . Display device
5*a* . . . Display section
5*b* . . . Display operating section
6 . . . Operating device
7, 7A . . . Machine body controller
8 . . . Engine control (EC) dial
9 . . . Engine
9*a* . . . Engine control device
10 . . . Hydraulic pump
10*a* . . . Pressure sensor
11 . . . Pilot pump
12 . . . Control valves
13 . . . Signal control valves
13*a* . . . Manipulation pressure sensor
14 . . . Regulator
14*a* . . . Pump control pressure sensor
50 . . . Operating state information display section
50*a* . . . Idle state display section
50*b* . . . Operating state display section
51, . . . , 60 . . . Display cells

The invention claimed is:

1. A display device for a work machine having an engine, a hydraulic pump driven by the engine, a plurality of actuators driven by a hydraulic fluid supplied from the hydraulic pump, and an operating device for operating the actuators, the display device comprising:

an idle state display section for displaying no-manipulation period operating state information which is related to an engine load that is imposed while the operating device is not manipulated; and an operating state display section that is disposed contiguously to the idle state display section to display manipulation period operating state information which is related to the engine load that is imposed while the operating device is manipulated;

wherein the idle state display section includes a low-idle display section and a high-idle display section, the low-idle display section and the high-idle display section being adapted to switch between an illuminated state and an extinguished state in accordance with the no-manipulation period operating state information; and wherein the high-idle display section goes into the illuminated state only when the no-manipulation period operating state information is higher than a predetermined reference value.

2. The display device according to claim 1, wherein the no-manipulation period operating state information is a revolution speed of the engine.

3. The display device according to claim 1, wherein the manipulation period operating state information is a fuel consumption of the engine.

4. The display device according to claim 1, wherein the manipulation period operating state information is a output of the hydraulic pump.

* * * * *